US005914225A

United States Patent [19]

Becher

[11] Patent Number: 5,914,225

[45] Date of Patent: Jun. 22, 1999

[54] COLOR PHOTOGRAPHIC ELEMENT WITH ENHANCED PROPERTIES AT REDUCED DEVELOPMENT TIMES

[75] Inventor: John H. Becher, Webster, N.Y.

[73] Assignee: Eastman Kodak Company, Rochester, N.Y.

[21] Appl. No.: 09/014,842

[22] Filed: Jan. 28, 1998

[51] Int. Cl.[6] ..... G03C 7/22

[52] U.S. Cl. ..... 430/543; 430/374; 430/375; 430/376; 430/391; 430/549

[58] Field of Search ..... 430/543, 549

[56] References Cited

U.S. PATENT DOCUMENTS

| | | | |
|---|---|---|---|
| 4,184,876 | 1/1980 | Eeles et al. | 430/505 |
| 4,946,767 | 8/1990 | Yamagami | 430/543 |

*Primary Examiner*—Hoa Van Le
*Attorney, Agent, or Firm*—Carl O. Thomas

[57] ABSTRACT

A color negative photographic element is disclosed that a pair of fast green and red recording layer units coated to receive exposing radiation prior to at least one pair of slow green and red recording layer units. The green recording layer units together contain at least 1.0 g/m$^2$ of silver with at least 60 percent of the silver in the green recording layer units being in a location other than the fast green recording layer unit, and the red recording layer units together contain at least 1.8 g/m$^2$ of silver with at least 70 percent of the silver in the red recording layer units being in a location other than the fast red recording layer unit. When development times are reduced to 2 minutes or less during processing increased red speed, reduced granularity of the green record, and increased sharpness of the red record are observed.

10 Claims, No Drawings

COLOR PHOTOGRAPHIC ELEMENT WITH ENHANCED PROPERTIES AT REDUCED DEVELOPMENT TIMES

FIELD OF THE INVENTION

The invention relates to color negative photographic elements and to their photographic processing.

DEFINITIONS

All references to silver halide grains and emulsions containing two or more halides name the halides in order of ascending concentrations.

In referring to blue, green and red recording layer units, the term "layer unit" indicates the hydrophilic colloid layer or layers that contain radiation-sensitive silver halide grains to capture exposing radiation and dye-forming couplers that react upon development of the grains. The grains and dye-forming coupler are usually in the same layer or layers, but can be in adjacent layers.

In referring to grains, the term "ECD" indicates mean equivalent circular diameter and, in describing tabular grains, "t" indicates mean tabular grain thickness.

All coating coverages are in units of $g/m^2$, except as otherwise stated. Silver halide coating coverages are based on silver.

All percentages are percent by weight, based on total weight, except as otherwise stated.

The term "E" is used to indicate exposure in lux-seconds.

A relative speed difference of 1 unit is equal to 0.01 log E.

In referring to processing times, primes (') are used to indicate minutes and double primes (") are used to indicate seconds.

*Research Disclosure* is published by Kenneth Mason Publications, Ltd., Dudley House, 12 North St., Emsworth, Hampshire P010 7DQ, England.

BACKGROUND

In a simple construction, a conventional color negative film intended for in camera exposure typically takes the following form:

| CNF-I |
|---|
| OC |
| BRLU |
| YFL |
| GRLU |
| IL |
| RRLU |
| AHL |
| TRANSPARENT FILM SUPPORT |

On the transparent film support are coated in the order shown, a series of processing solution penetrable hydrophilic colloid layers: antihalation layer AHL, a red recording layer unit RRLU containing a red sensitized silver iodobromide (AgIBr) emulsion and a cyan dye-forming coupler, an interlayer IL containing an oxidized developing agent scavenger, a green recording layer unit GRLU containing a green sensitized AgIBr emulsion and a magenta dye-forming coupler, a yellow filter layer YFL containing a Carey Lea silver or a processing solution decolorizable yellow filter dye and an oxidized developing agent scavenger, a blue recording layer unit BRLU containing blue sensitive (optionally blue sensitized) AgIBr emulsion and a yellow dye-forming coupler, and a transparent protective overcoat OC. In the simplest possible construction capable of producing a color negative image, all of the hydrophilic colloid layers, except BRLU, GRLU and RRLU can be omitted. In the overwhelming majority of practical applications all of the layers of CNF-I described above are employed and, most commonly, many additional addenda are incorporated for performance enhancement.

In their simplest possible construction each of BRLU, GRLU and RRLU contain a single AgIBr emulsion. However, as elaborated on in *Research Disclosure*, Vol. 389, September 1996, Item 38957, I. Emulsion grains and their preparation, E. Blends, layers and performance categories, paragraph (7), when a fast emulsion layer is coated over a slow emulsion layer, an increase in imaging speed without an offsetting increase in granularity can be realized. Therefore, it is common practice to double-coat or triple-coat by splitting the AgIBr emulsions in BRLU, GRLU and RRLU into two or three separate emulsion layers differing in imaging speed.

A typical double-coated color negative film construction can take the following form:

| CNF-II |
|---|
| OC |
| BRLU Fast blue recording emulsion layer |
| Slow blue recording emulsion layer |
| YFL |
| GRLU Fast green recording emulsion layer |
| Slow green recording emulsion layer |
| IL |
| RRLU Fast red recording emulsion layer |
| Slow red recording emulsion layer |
| AHL |
| TRANSPARENT FILM SUPPORT |

Since this arrangement locates the fast green and fast red emulsion layers beneath slow emulsion layers, alternative arrangements have been suggested from time to time, such as illustrated by the following:

| CNF-III |
|---|
| OC |
| Fast BRLU |
| IL |
| Fast GRLU |
| IL |
| Fast RRLU |
| IL |
| Slow BRLU |
| YFL |
| Slow GRLU |
| IL |
| Slow RRLU |
| AHL |
| TRANSPARENT FILM SUPPORT |

This arrangement differs from CNF-II in that it separates the fast and slow emulsion layers in each recording layer unit of CNF-II into separate recording layer units with the fast recording layer units located to receive exposing radiation prior to the slow recording layer units, but it does not succeed entirely in protecting the green and red exposure records from blue light contamination, attributable to the native blue sensitivity of the AgIBr emulsions in the fast green and red recording layer units.

An alternative construction is disclosed by Eeles and O'Neill U.S. Pat. No. 4,184,876, as illustrated by the following:

| CNF-IV |
|---|
| OC |
| BRLU |
| YFL |
| Fast GRLU |
| IL |
| Fast RRLU |
| IL |
| Slow GRLU |
| IL |
| Slow RRLU |
| AHL |
| TRANSPARENT FILM SUPPORT |

The blue recording layer unit can be constructed as in CNF-I or CNF-II. The yellow filter layer YFL is located to protect all of the green and red recording layer units from exposure to blue light. The positioning of the fast red recording layer unit Fast RRLU above the slow green recording layer unit Slow GRLU results in a significant increase in the red speed of the color negative film while degrading the acutance (sharpness) of the green image record only slightly.

The Kodak Flexicolor™ C-41 process is commonly employed for processing imagewise exposed color negative films. Since minor adjustments of the C-41 process are undertaken from time to time, the following detailed description is provided:

| | | |
|---|---|---|
| Develop | 3'15" Developer | 37.8° C. |
| Bleach | 4' Bleach | 37.8° C. |
| Wash | 3' | 35.5° C. |
| Fix | 4' Fixer | 37.8° C. |
| Wash | 3' | 35.5° C. |
| Rinse 1' | Rinse | 37.8° C. |

Developer

| | | |
|---|---|---|
| Water | 800.0 | mL |
| Potassium Carbonate, anhydrous | 34.30 | g |
| Potassium bicarbonate | 2.32 | g |
| Sodium sulfite, anhydrous | 0.38 | g |
| Sodium metabisulfite | 2.96 | g |
| Potassium Iodide | 1.20 | mg |
| Sodium Bromide | 1.31 | g |
| Diethylenetriaminepentaacetic acid pentasodium salt (40% soln) | 8.43 | g |
| Hydroxylamine sulfate | 2.41 | g |
| N-(4-amino-3-methylphenyl)-N-ethyl-2-aminoethanol | 4.52 | g |
| Water to make | 1.0 | L |
| pH @ 26.7° C. 10.00 +/− 0.05 | | |

Bleach

| | | |
|---|---|---|
| Water | 500.0 | mL |
| 1,3-Propylenediamine tetra-acetic acid | 37.4 | g |
| 57% Ammonium hydroxide | 70.0 | mL |
| Acetic acid | 80.0 | mL |
| 2-Hydroxy-1,3-propylenediamine tetraacetic acid | 0.8 | g |
| Ammonium Bromide | 25.0 | g |
| Ferric nitrate nonahydrate | 44.85 | g |
| Water to make | 1.0 | L |
| pH 4.75 | | |

Fix

| | | |
|---|---|---|
| Water | 500.0 | mL |
| Ammonium Thiosulfate (58% solution) | 214.0 | g |
| (Ethylenedinitrilo)tetraacetic acid disodium salt, dihydrate | 1.29 | g |

-continued

| | | |
|---|---|---|
| Sodium metabisulfite | 11.0 | g |
| Sodium Hydroxide (50% solution) | 4.70 | g |
| Water to make | 1.0 | L |
| pH at 26.7° C. 6.5 +/− 0.15 | | |

Rinse

| | | |
|---|---|---|
| Water | 900.0 | mL |
| 0.5% Aqueous p-tertiary-octyl-(α-phenoxypolyethyl)alcohol | 3.0 | mL |
| Water to make | 1.0 | L |

SUMMARY OF THE INVENTION

It has been discovered quite unexpectedly that, when color negative processing is shortened by reducing development times to 2 minutes or less, adjustments in the proportions of silver in the fast and slow green and red recording layer units in a CNF-IV type layer arrangement results in unexpected performance advantages. Compared to CNF-II type layer arrangements similarly modified and processed, the CNF-IV type layer arrangements of the color negative films of the invention exhibited (1) increased red speed, (2) reduced granularity of the green record, and (3) increased sharpness of the red record. Compared to CNF-III type layer arrangements similarly modified and processed, the CNF-IV type layer arrangements of the color negative films of the invention exhibited (I) reduced granularity of the green record and (2) increased sharpness of the red record. Although Eeles and O'Neill, cited above, reported increased red speeds for CNF-IV type layer arrangements, the speed increases realized with the CNF-IV layer arrangements modified for 2 minute or less development times according to the invention were much larger than observed with standard 3' 15" processing and larger than previously reported by Eeles and O'Neill.

In one aspect this invention is directed to a photographic element capable of producing a color negative image comprised of a transparent film support and, coated on the support, a blue recording layer unit, containing blue sensitive silver iodobromide grains and yellow dye-forming coupler, located to receive exposing radiation prior to all other recording layer units, a yellow filter layer located to receive exposing radiation from the blue recording layer unit, a pair of fast recording layer units located to receive exposing radiation from the yellow filter layer consisting of a fast green recording layer unit and a fast red recording layer unit, and at one least one pair of slow green and slow red recording layers units located to receive exposing radiation from the fast green and fast recording layer units, each green recording layer unit containing green sensitized silver iodobromide grains and magenta dye-forming coupler, each red recording layer unit containing red sensitized silver iodobromide grains and cyan dye-forming coupler, and in each recording layer unit pair the green recording layer unit being positioned to receive exposing radiation prior to the red recording layer unit, wherein, the green recording layer units together contain at least 1.0 g/m$^2$ of silver with at least 60 percent of the silver in the green recording layer units being in a location other than the fast green recording layer unit, and the red recording layer units together contain at least 1.8 g/m$^2$ of silver with at least 70 percent of the silver in the red recording layer units being in a location other than the fast red recording layer unit.

In another aspect this invention is directed to a process of producing a color negative image in an imagewise exposed photographic element according to the invention comprised of developing the imagewise exposed photographic element in 2 minutes or less to create a silver image and yellow, magenta and cyan dye images, bleaching the developed silver, and fixing to remove silver halide.

DESCRIPTION OF PREFERRED EMBODIMENTS

The present invention is directed to improving the imaging perfonnance of color negative films having a CNF-IV type layer arrangement when processed by development in 2 minutes or less.

CNF-IV is the type of double-coated layer arrangement investigated by Eeles and O'Neill. This general class of layer arrangements are distinguished from other layer arrangements by a blue recording layer unit that is located to receive exposing radiation prior to any green or red recording layer unit. Located to receive exposing radiation from the blue recording layer unit are multiple (usually, two or three) pairs of green and red recording layer units. In each pair the green recording layer unit is located to receive exposing radiation prior to the red recording layer unit. The first pair of green and red recording layer units to receive exposing radiation have a lower imaging threshold (i.e., have a higher sensitivity or speed) than any other pair of green and red recording layer units. Hence, in keeping with common practice the green and red recording layer units in the first pair are referred to as the fast green and fast red recording layer units. Fast green and fast red recording layer units usually are constructed employing emulsions having a higher imaging speed than those in other green and red recording layer units, but their speed advantage is at least partially and can be totally the result of their favored location for receiving exposing radiation. The pair or pairs of slow green and slow red recording layer units receive exposing radiation that has passed through the pair of fast green and fast red recording layer units.

A typical construction of a color negative film satisfying invention requirements is illustrated by the following:

| CNF-IV-tc | |
|---|---|
| (1) | OC |
| (2) | BRLU |
| (3) | YFL |
| (4) | Fast GRLU |
| (5) | IL |
| (6) | Fast RRLU |
| (7) | IL |
| (8) | Slow GRLU |
| (9) | IL |
| (10) | Slow RRLU |
| (11) | IL |
| (12) | Slow GRLU |
| (13) | IL |
| (14) | Slow RRLU |
| (15) | AHL |
| | TRANSPARENT FILM SUPPORT |

The fast green recording layer unit (4) and the fast red recording layer unit (6) exhibit a higher imaging speed than any remaining green or red recording layer unit. The slow green recording layer unit (8) and the slow red recording layer unit (10) form a second layer unit pair having an imaging speed that is slower than that of (4) and (6). The slow green recording layer unit (12) and the slow red recording layer unit (14) form a third layer unit pair having an imaging speed that is slower than that of the second layer unit pair. The lower speed of the third layer unit pair can be created by the choice of emulsions incorporated; however, the slower speed of the third layer unit pair is at least partially a determined by the placement of (12) and (14) to receive exposing radiation subsequent to the first and second layer unit pairs. Even when layer units (8) and (12) are identical in content, layer unit (12) is necessarily be slower by reason of its less favored placement. Similarly, even when layer units (10) and (14) are identical in content, layer unit (14) is necessarily be slower by reason of its less favored placement. The first pair of green and red recording layer units (4) and (6) determine the green and red speeds of the element. The second pair of green and red recording layer units (8) and (10) function to provide adequate exposure latitude for most imaging applications. The third pair of green and red recording layer units (12) and (14) are optional, but useful for providing a sufficiently wide range of exposure latitudes to capture without compromise the most demanding photographic scenes (e.g., a white wedding dress and a black tuxedo in the same scene) and to provide a capability for image capture on over exposure.

In a CNF-IV (double-coated) or CNF-IV-tc (triple-coated) layer arrangement intended for color negative processing with development times of 2 minutes or less the total amount of silver in the green recording layer units is contemplated to be at least 1 g/m$^2$, typically from 1.0 to 2.8 g/m$^2$. The total amount of silver in the red recording layer units is contemplated to be at least 1.8 g/m$^2$, typically from 1.8 to 3.6 g/m$^2$. The higher amounts of total silver incorporated in the red recording layer units as compared to the green recording layer units are dictated by the less favored position of the red recording layer units for receiving exposing radiation as compared to the green recording layer units.

It has discovered quite unexpectedly that CNF-IV layer arrangements produce superior color images when color negative processing is employed in which development times are reduced to 2 minutes or less. This has been achieved by redistributing the silver between the fast and slow recording layer units. Specifically, the proportion of silver in fast green and fast red recording layer units is reduced.

At least 60 percent of the total silver in the green recording layer units is in a location other than the fast recording layer unit—i.e., in the slow green recording layer unit or units. Preferably at least 20 percent of the total silver in the green recording layer units is retained in the fast green recording layer unit. In other words, typically from 60 to 80 percent of the total silver in the green recording layer units is in a location other than the fast recording layer unit. The fast green recording layer unit optimally contains at least 30 percent of the total silver in the green recording layer units.

At least 70 percent of the total silver in the red recording layer units is in a location other than the fast recording layer unit—i.e., in the slow red recording layer unit or units. Preferably at least 75 percent of the total silver in the red recording layer units is retained in a location other than the fast red recording layer unit, typically from 70 to 90 percent of the total silver in the red recording layer units. The fast red recording layer unit thus in all instances contains at least 10 percent of the total silver in the red recording layer units.

Quite surprisingly, even when comparable shifts in silver between the fast and slow green and the fast and slow red recording layer units of color negative films having CNF-II and CNF-III layer arrangements are employed, their imaging characteristics resulting from color negative processing using development times of 2 minutes or less are clearly inferior to those of the color negative films of the invention having CNF-IV double-coated or triple-coated layer arrangements.

Except for the features previously noted, the construction of the color negative films of the invention can take any convenient conventional form. Color negative films contain transparent film supports to facilitate exposure of a color print element through the color negative image in the film. The support can be either colorless or tinted. Details of film support construction are well understood in the art. Transparent film supports, including subbing layers to enhance adhesion are disclosed in *Research Disclosure*, Item 38957, cited above, XV. Supports.

All of the layers coated on the support in the layer arrangements described above are intended to be penetrated by processing solutions. Thus, these layers are all constructed employing hydrophilic colloid, such as gelatin or gelatin derivatives, as a vehicle. Hydrophilic colloid vehicles (including peptizers and binders) as well as vehicle extenders, such as latices, hydrophilic colloid modifiers (e.g., hardeners) as well as other related addenda are disclosed in *Research Disclosure*, Item 38957, II. Vehicles, vehicle extenders, vehicle-like addenda and vehicle related addenda.

The antihalation layers AHL are optional, but preferred to increase image sharpness. Instead of placing AHL between a red recording layer unit and the transparent film support as shown, it is also well known to place the antihalation layer on the back side of the support. As shown above, AHL in this instance is repositioned below the transparent film support. The antihalation layer contains a dye that can be decolorized in processing. In other words, AHL absorbs light during imagewise exposure, but is rendered colorless prior to printing. If AHL leaves any residual stain, this can be compensated for by adjusting the light source used in printing. Useful antihalation dyes and their decolorization are illustrated by *Research Disclosure*, Item 38957, XIII. Absorbing and scattering materials, B. Absorbing materials and C. Discharge.

The interlayers IL as well as YFL separate recording layer units that are responsive to different regions of the spectrum. An oxidized developing agent scavenger (also sometimes referred to as an antistain agent) is preferably positioned in IL and YFL to reduce or eliminate color contamination resulting from the migration of oxidized developing agent between recording layer units. Oxidized developing agent scavengers are disclosed in *Research Disclosure*, Item 38957, X. Dye image formers and modifiers, D. Hue modifiers/stabilization, paragraph (2).

The yellow filter layer YFL additionally contains either Carey Lea silver, which is removed during bleaching and fixing, or a yellow dye that can be decolorized during processing. Suitable yellow filter dyes are included among the dyes disclosed in *Research Disclosure*, Item 38957, B. Absorbing materials, cited above.

Each of the blue, green and red recording layer units contain radiation-sensitive silver iodobromide emulsions. The grains contain at least 0.1 (preferably at least 0.5) mole percent iodide, based on silver, to increase photographic speed in relation to mean ECD and hence granularity. Higher iodide concentrations are commonly employed in arriving at non-uniform iodide distributions that make further contributions in imaging speed. However, overall iodide concentrations are commonly elevated to improve image structure (e.g., to achieve interimage effects). Iodide concentrations up to the saturation level of iodide ion in a silver bromide crystal lattice structure are contemplated, typically about 40 mole percent, depending upon the exact conditions of grain precipitation. It is usually preferred to limit iodide concentrations to less than 15 (most preferably <10 and optimally<5) mole percent, based on silver.

The grains of the silver iodobromide emulsions can be either regular or irregular (e.g., tabular). In the blue recording layer unit the native blue sensitivity of the AgIBr grains can be relied upon to capture exposing radiation. When a blue absorbing spectral sensitizing dye is adsorbed to the surface of the grains, blue light absorption is increased. Both tabular and nontabular grain AgIBr emulsions are commonly employed in blue recording layer units.

Tabular grain emulsions, those in which tabular grains account for at least 50 (preferably at least 70 and optimally at least 90) percent of total grain projected area are particularly advantageous for increasing speed in relation to granularity in the green or red spectrally sensitized emulsions employed in green and red recording layer units. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically preferred. The grains preferably form surface latent images so that they produce negative images when processed in a surface developer.

Illustrations of conventional radiation-sensitive silver halide emulsions, including both tabular and nontabular grain AgIBr emulsions, are provided by *Research Disclosure*, Item 38957, I. Emulsion grains and their preparation. Chemical sensitization of the emulsions, which can take any conventional form, is illustrated in section IV. Chemical sensitization. Spectral sensitization and sensitizing dyes, which can take any conventional form, are illustrated by section V. Spectral sensitization and desensitization. The emulsion layers also typically include one or more antifoggants or stabilizers, which can take any conventional form, as illustrated by section VII. Antifoggants and stabilizers.

The blue recording layer unit contains at least one yellow dye-forming coupler. Each green recording layer unit contains at least one magenta dye-forming coupler, and each red recording layer unit contains at least one cyan dye-forming coupler. Any convenient combination of conventional dye image-forming couplers can be employed. Conventional dye image-forming couplers are illustrated by *Research Disclosure*, Item 38957, cited above, X. Dye image formers and modifiers, B. Image-dye-forming couplers. Dye-forming couplers that combine with oxidized developer to produce cyan colored dyes are listed in paragraph (4). Dye-forming couplers that combine with oxidized developer to produce magenta colored dyes are listed in paragraph (5). Dye-forming couplers that combine with oxidized developer to produce yellow colored dyes are listed in paragraph (6). Compounds that are used with dye-forming couplers to modify the dye image, which are themselves often (but not always) dye-forming couplers, are disclosed in *Research Disclosure*, Item 13857, X. Dye image formers and modifiers, C. Image dye modifiers and D. Hue modifiers/stabilization. Techniques for dispersing dye-forming couplers and image dye modifiers are disclosed in E. Dispersing dyes and dye precursors.

Since dye-forming couplers often produce image dyes that exhibit significant absorption outside the desired region of the spectrum, it is common practice to incorporate masking dyes, including colored masking couplers, in color negative films. The masking couplers are incorporated with the dye image-forming couplers in the recording layer units. Preformed masking dyes that remain invariant in hue during processing can be incorporated in the recording layer units or in any other layer that does not interfere with imagewise exposure—e.g., in the antihalation layer. Masking dyes, including colored masking couplers, are disclosed in *Research Disclosure*, Item 38957, XII. Features applicable only to color negative, particularly paragraphs (1) and (2).

The surface overcoats OC are hydrophilic colloid layers that are provided for physical protection of the color negative elements during handling and processing. Each OC also provides a convenient location for incorporation of addenda that are most effective at or near the surface of the color negative element. In some instances the surface overcoat is divided into a surface layer and an interlayer, the latter functioning as a spacer between the addenda in the surface layer and the adjacent recording layer unit. In another common variant form, addenda are distributed between the surface layer and the interlayer, with the latter containing addenda that are compatible with the adjacent recording layer unit. Most typically OC contains addenda, such as coating aids, plasticizers and lubricants, antistats and matting agents, such as illustrated by *Research Disclosure*, Item 38957, IX. Coating physical property modifying addenda. It is also common practice to coat an overcoat layer on the back side of the support to locate some or all of the physical property modifying addenda also adjacent to the back surface of the film. The overcoat layers overlying the emulsion layers additionally preferably contains an ultraviolet absorber, such as illustrated by *Research Disclosure*, Item 38957, VI. UV dyes/optical brighteners/luminescent dyes, paragraph (1).

The color negative films of the invention can be imagewise exposed in any convenient conventional manner. The color negative films are specifically contemplated for use as camera speed films having ISO ratings of from 10 to 2000, most commonly from ISO 100 to ISO 1000. They can be color balanced for exposure under tungsten illumination, for daylight exposure or for flash exposure.

Following imagewise exposure photographic processing can be undertaken to produce internal yellow, magenta and cyan negative dye images useful for printing a viewable color positive image. In a preferred form it is contemplated to modify the Kodak Flexicolor™ C-41 process described above by reducing development times to 2 minutes or less. Development times of 1 minute are demonstrated in the Examples below, and development times of 30" or less are considered feasible. Apart from the required modifications of the color negative films described above, the reduction in development time from 3' 15" to 2' or less can be accomplished while retaining good image qualities by increasing the temperature of the development step. Development temperatures of up to about 80° C. are contemplated. It is also possible to modify the developer composition to increase its activity, thereby contributing to shorter processing times. Further, it is possible to adjust dye-forming coupler concentrations and activity levels in the color negative films to allow for more rapid development. Development temperatures of from 40 to 60° C. are preferred for accelerated development, most preferably in combination with one or more of the optional color negative film adjustments of the type described above.

Although the color negative films of the invention are specifically contemplated for use in a shortened development step form of the Kodak Flexicolor™ C-41, demonstrated in the Examples below, it is appreciated that useful color negative images can be obtained in a wide variety of processing compositions and under a variety of processing conditions. For example, color negative elements satisfying the requirements of the invention can be processed in 2' or less in similarly modified commercial color negative processes, such as the Kodacolor C-22 ™ process, the Agfacolor processes described in *British Journal of Photography Annual*, 1977, pp. 201–205, and 1988, pp. 196–198, Kodak motion picture processes ECN-2, ECN-2a and ECN-2b.

In color negative processing the first and only absolutely essential step to creating the internal yellow, magenta and cyan dye image structure sought is the step of color development. Color developing solutions typically contain a primary aromatic amino color developing agent. These color developing agents are well known and widely used in a variety of color photographic processes. They include aminophenols and p-phenylenediamines.

Examples of aminophenol developing agents include o-aminophenol, p-aminophenol, 5-amino-2-hydroxytoluene, 2-amino-3-hydroxytoluene, and 2-hydroxy-3-amino- 1,4-dimethylbenzene.

Particularly useful primary aromatic amino color developing agents are the p-phenylenediamines and especially the N,N-dialkyl-p-phenylenediamines in which the alkyl groups or the aromatic nucleus can be substituted or unsubstituted. Examples of useful p-phenylenediamine color developing agents include: N,N-diethyl-p-phenylenediamonohydrochloride, 4-N,N-diethyl-2-methylphenylenediamine monohydrochloride, 4-(N-ethyl)-N-2-methanesulfonylaminoethyl)-2-methylphenylenediamine sesquisulfate monohydrate and 4-(N-ethyl-N-2-hydroxyethyl)-2-methylphenylenediamine sulfate.

In addition to the primary aromatic amino color developing agent, color developing solutions typically contain a variety of other agents, such as alkali hydroxides to control pH, halides (e.g., bromides and/or iodides), benzyl alcohol, antioxidants, antifoggants, solubilizing agents, and brightening agents. Useful developer addenda are disclosed in *Research Disclosure*, Item 38957, XIX. Development, except that only color developing agents are useful.

Color developing compositions are employed in the form of aqueous alkaline working solutions having a pH of above 7 and typically in the range of from 9 to 13. To provide the necessary pH, the solutions contain one or more of the well known and widely used buffering agents, such as the alkali metal carbonates or phosphates. Potassium carbonate is especially useful as a buffering agent for color developing compositions.

Once the color negative dye images are obtained by development it is conventional practice to reconvert developed silver to silver halide by bleaching and then to remove the silver halide by fixing. Removal of the silver image removes the neutral silver density that is superimposed on the image dye density thereby constituting a hindrance to printing. Removal of the silver halide by fixing is undertaken to allow the developed color negative element to be handled in room light without printout (that is, without reduction of the remaining silver halide to silver) which objectionably increases minimum densities of each of the dye images. Bleaching and fixing can both be accomplished in a single bleach-fix (a.k.a., blix) solution, if desired. It is common practice to use a stop bath, such as dilute acetic acid, to lower pH and terminate color development. Usually washing or rinsing steps are conducted between development and bleaching and, where separate bleach and fix solutions are employed, between the bleaching and fixing step. A washing step is also commonly used after fixing.

*Research Disclosure*, Item 38957, XX. Desilvering, washing, rinsing and stabilizing, discloses bleaching solutions, fixing solutions, bleach-fixing solutions, and washing, rinsing and stabilizing solutions that can be used in the photographic processing of the invention.

EXAMPLES

The invention can be better appreciated by reference to the following specific embodiments.

Example 1

Preparation of Dispersion of C-12

Compound C-12 in the amount of 300.0 grams was dissolved in 300.0 grams of di-n-butyl phthalate at 140° C. and then added to an aqueous solution of 450.0 grams of gelatin, 300.0 grams of a 10% solution of the surfactant Alkanol-XC™ (DuPont), 8.0 grams of a 0.7% solution of the biocide Kathon LX™ (Rohm & Haas), and 3642.0 grams of distilled water. This mixture was blended using a Silverson™ mixer for 5 minutes at 5000 rpm, then passed through a Crepaco™ homogenizer one time at 5000 psi (34,475 KPa) to provide a dispersion consisting of 6.0% coupler and 9.0% gelatin.

Example 2

Comparison of CNF-II and CNF-IV Multilayer Films at Normal Processing Conditions The multilayer film structures utilized for the example are shown schematically for Films A and B in Tables I and II respectively. Component laydowns in g/m$^2$ are shown in parenthesis. Gelatin was used as a binder in the various film layers.

TABLE I

| Multilayer Film A Structure | |
|---|---|
| Overcoat Layer | Matte Beads<br>UV Absorber UV-7 (0.108) & S-9 (0.108)<br>UV Absorber UV-8 (0.108) & S-9 (0.108)<br>Silver Bromide Lippmann Emulsion (0.215)<br>Gelatin (0.70)<br>Bis(vinylsulfonyl)methane Hardener (at 1.8% by weight of total gelatin) |
| Fast Yellow Layer | Y-15 (0.108) & S-2 (0.108)<br>Y-14 (0.183) & S-2 (0.092)<br>D-3 (0.097) & S-2 (0.097)<br>C-22 (0.005) (BARC) & S-3 (0.005)<br>Blue Sensitized Silver Iodobromide Emulsion (0.592 Ag)<br>4.1 mole % Iodide T-Grain ™ (ECD 2.6 μm, t 0.134 μm)<br>Gelatin (1.53) |
| Slow Yellow Layer | Y-15 (0.430) & S-2 (0.430)<br>Y-14 (0.484) & S-2 (0.242)<br>D-3 (0.086) & S-2 (0.086)<br>C-22 (0.011) (BARC) & S-3 (0.011)<br>Blue Sensitized Silver Iodobromide Emulsion (0.108 Ag)<br>4.1 mole % Iodide T-Grain ™ (ECD 1.3 μm, t 0.13 μm)<br>Blue Sensitized Silver Iodobromide Emulsion (0.108 Ag)<br>1.5 mole % Iodide T-Grain ™ (ECD 1.0 μm × 0.13 μm)<br>Blue Sensitized Silver Iodobromide Emulsion (0.108 Ag)<br>1.3 mole % Iodide T-Grain ™ (ECD 0.54 μm, t 0.84 μm)<br>Gelatin (1.95) |
| Interlayer | Dye-4 Filter Dye (0.108)<br>ST-4 (0.086) & S-2 (0.139)<br>Gelatin (0.646) |

TABLE I-continued

| Multilayer Film A Structure | |
|---|---|
| Fast Magenta Layer | M-5 (0.032) Magenta Dye Forming Coupler & S-1 (0.026) & ST-5 (0.906) Addendum<br>MC-2 (0.054) Masking Coupler & S-1 (0.108)<br>D-4 (0.011) & S-2 (0.011)<br>Green Sensitized Silver Iodobromide Emulsion (0.484 Ag)<br>4.1 mole % Iodide T-Grain ™ (ECD 1.25 μm, t 12 μm)<br>Gelatin (0.742) |
| Mid Magenta Layer | M-5 (0.161) & S-1 (0.129) & ST-5 Addendum (0.032)<br>MC-2 (0.065) Masking Coupler & S-1 (0.129)<br>D-4 (0.043) & S-1 (0.043)<br>Green Sensitized Silver Iodobromide Emulsion (0.699 Ag)<br>4.1 mole % Iodide T-Grain ™ (ECD 1.05 μm, t 0.115<br>Gelatin (0.850) |
| Slow Magenta Layer | M-5 (0.377) & S-1 (0.301) & ST-5 Addendum (0.076)<br>MC-2 (0.065) Masking Coupler & S-1 (0.129)<br>Green Sensitized Silver Iodobromide Emulsion (0.161 Ag)<br>2.6 mole % Iodide T-Grain ™ (ECD 0.75 μm, t 0.115 μm)<br>Green Sensitized Silver Iodobromide Emulsion (0.054 Ag)<br>1.3 mole % Iodide T-Grain ™ (ECD 0.54 μm, t 0.084 μm)<br>Gelatin (0.990) |
| Interlayer | ST-4 Oxidized Developer Scavenger (0.075) & S-2 (0.122)<br>Gelatin (0.430) |
| Fast Cyan Layer | C-2 (0.129) Cyan Dye-Forming Coupler & S-2 (0.129)<br>C-2 (0.030) & B-1 (0.030) DIAR & S-2 (0.060)<br>C-2 (0.048) & D-5 (0.048) DIR & S-1 (0.097)<br>MC-1 (0.032) Masking Coupler<br>Red Sensitized Silver Iodobromide Emulsion (0.430 Ag)<br>4.1 mole % Iodide T-Grain ™ (ECD 1.25 μm, t 0.12 μm)<br>Gelatin (0.807) |
| Mid Cyan Layer | C-2 (0.355) & S-2 (0.355)<br>C-2 (0.019) & B-1 (0.019) & S-2 (0.039)<br>C-22 (0.008) & S-3 (0.008)<br>MC-1 (0.032)<br>Red Sensitized Silver Iodobromide Emulsion (0.721 Ag)<br>4.1 mole % Iodide T-Grain ™ (ECD 1.05, t 0.115 μm)<br>Gelatin (1.12) |
| Slow Cyan Layer | C-2 (0.538) & S-2 (0.0538)<br>C-2 (0.008) & B-1 (0.008) & S-2 (0.016)<br>C-22 (0.056) & S-3 (0.056)<br>Y-15 (0.065) & S-2 (0.065)<br>Red Sensitized Silver Iodobromide Emulsion (0.248 Ag)<br>4.1 mole % Iodide T-Grain ™ (ECD 0.73, t 0.12 μm)<br>Red Sensitized Silver Iodobromide Emulsion (0.237 Ag)<br>1.3 mole % Iodide T-Grain ™ (ECD 0.54, t 0.084 μm)<br>Gelatin (1.36) |
| Antihalation Layer | Grey Silver (0.151 Ag)<br>Dye-7 (0.011)<br>Dye-5 (0.047)<br>Dye-6 (0.092)<br>ST-4 (0.108) & S-2 (0.172)<br>UV-7 (0.075) & S-9 (0.075)<br>UV-8 (0.075) & S-9 (0.075)<br>Gelatin (1.61)<br>Cellulose Triacetate Support |

TABLE II

| Multilayer Film B Structure | |
|---|---|
| Overcoat Layer | Matte Beads<br>UV Absorber UV-7 (0.108) & S-9 (0.109)<br>UV Absorber UV-8 (0.108) & S-9 (0.109)<br>Silver Bromide Lippman Emulsion (0.215)<br>Gelatin (0.699)<br>Bis(vinylsulfonyl)methane Hardener (at 1.8% by weight of total Gelatin) |

TABLE II-continued

| Multilayer Film B Structure | |
|---|---|
| Fast Yellow Layer | Y-15 (0.161) & S-2 (0.161)<br>D-3 (0.097) & S-2 (0.097)<br>C-22 (0.005) (BARC) & S-3 (0.005)<br>Blue Sensitized Silver Iodobromide Emulsion (0.592 Ag)<br>4.1 mole % Iodide T-Grain ™ (ECD 2.6 μm, t 0.134 μm)<br>Gelatin (1.36) |
| Slow Yellow Layer | Y-15 (0.624) & S-2 (0.624)<br>D-3 (0.086) & S-2 (0.086)<br>C-22 (0.011) (BARC) & S-3 (0.011)<br>Blue Sensitized Silver Iodobromide Emulsion (0.086 Ag)<br>4.1 mole % Iodide T-Grain ™ (ECD 1.3 μm, t 0.13 μm)<br>Blue Sensitized Silver Iodobromide Emulsion (0.248 Ag)<br>1.5 mole % Iodide T-Grain ™ (ECD 1.0 μm, t 0.13 μm)<br>Blue Sensitized Silver Iodobromide Emulsion (0.151 Ag)<br>1.3 mole % Iodide T-Grain ™ (ECD 0.54 μm, t 0.84 μm)<br>Gelatin (1.95) |
| Interlayer | Dye-4 Filter Dye (0.108)<br>ST-4 (0.086) & S-2 (0.139)<br>Gelatin (0.646) |
| Fast Magenta Layer | M-5 (0.043) Magenta Dye Forming Coupler & S-1 (0.034) & ST-5 (0.009) Addendum<br>MC-2 (0.086) Masking Coupler & S-1 (0.172)<br>D-4 (0.022) & S-2 (0.022)<br>Green Sensitized Silver Iodobromide Emulsion (0.484 Ag)<br>4.1 mole % Iodide T-Grain ™ (ECD 1.25 μm, t 0.12 μm)<br>Gelatin (0.742) |
| Interlayer | ST-4 Oxidized Developer Scavenger (0.075) & S-2 (0.122)<br>Gelatin (0.430) |
| Fast Cyan Layer | C-2 (0.129) Cyan Dye Forming Coupler & S-2 (0.129)<br>C-2 (0.030) & B-1 (0.030) DIAR & S-2 (0.060)<br>C-2 (0.048) & D-5 (0.048) DIR & S-1 (0.097)<br>Red Sensitized Silver Iodobromide Emulsion (0.430 Ag)<br>4.1 mole % Iodide T-Grain ™ (ECD 1.25 μm, t 0.12 μm)<br>Gelatin (0.807) |
| Interlayer | ST-4 Oxidized Developer Scavenger (0.075) & S-2 (0.122)<br>Gelatin (0.430) |
| Slow Magenta Layer | M-5 (0.323) & S-1 (0.258) & ST-5 Addendum (0.065)<br>MC-2 (0.129) Masking Coupler & S-1 (0.258)<br>D-4 (0.032) & S-2 (0.032)<br>Green Sensitized Silver Iodobromide Emulsion (0.323 Ag)<br>4.1 mole % Iodide T-Grain ™ (ECD 1.16 μm, t 0.114 μm)<br>Green Sensitized Silver Iodobromide Emulsion (0.215 Ag)<br>1.5 mole % Iodide T-Grain ™ (ECD 0.69, t 0.117 μm)<br>Green Sensitized Silver Iodobromide Emulsion (0.108 Ag)<br>1.3 mole % Iodide T-Grain ™ (ECD 0.54, t 0.084 μm)<br>Gelatin (0.850) |
| Interlayer | ST-4 Oxidized Developer Scavenger (0.075) & S-2 (0.122)<br>Gelatin (0.430) |
| Slow Cyan Layer | C-2 (0.646) & S-2 (0.646)<br>C-22 (0.008) & S-3 (0.008)<br>Red Sensitized Silver Iodobromide Emulsion (0.516 Ag)<br>4.1 mole % Iodide T-Grain ™ (ECD 1.19 μm, t 0.114 μm)<br>Red Sensitized Silver Iodobromide Emulsion (0.441 Ag)<br>1.3 mole % Iodide T-Grain ™ (ECD 0.54 μm, t 0.084 μm)<br>Gelatin (1.12) |
| Antihalation Layer | Grey Silver (0.151 Ag)<br>Dye-7 (0.011)<br>Dye-5 (0.047)<br>Dye-6 (0.092)<br>ST-4 (0.108) & S-2 (0.172)<br>UV-7 (0.075) & S-9 (0.075)<br>UV-8 (0.075) & S-9 (0.075)<br>Gelatin (1.61)<br>Cellulose Triacetate Support |

Both films were exposed through a step tablet on an Eastman™ 1B sensitometer and processed through the KODAK FLEXICOLOR™ C-41 process described below. The step tablet was divided into 21 density steps, with step 1 having density of 4 and step 21 having a density of zero.

TABLE III

C-41 Processing Solutions and Conditions

| Solution | Agitation | Processing Time | Temperature |
|---|---|---|---|
| Developer | Nitrogen Burst | 3'15" | 37.8 C. |
| Fresh Bleach II | Continuous Air | 4' | 37.8 C. |
| Wash | Continuous Air | 3' | 35.5 C. |
| Fix | Continuous Air | 4' | 37.8 C. |
| Wash | Continuous Air | 3' | 35.5 C. |
| PHOTO-FLO ™ | None | 1' | 37.8 C. |

The Status M densities of the processed films were then measured via a densitometer and density vs Log exposure curves were plotted and measured. The red and green inertial speeds were measured at densities=Dmin+0.15 for each color. The red and green gammas were measured via a least squares fit to the sensitometric curves. The speeds and gammas for Films A and B in the standard C-41 process of Table III are compared in Table IV below:

TABLE IV

Sensitometric Comparison of Films A & B in Normal C-41 Process

| | | Relative Speed | | Gamma | |
|---|---|---|---|---|---|
| Film | TOD* | Red | Green | Red | Green |
| A | 3'15" | 323 | 334 | 0.60 | 0.64 |
| B | 3'15" | 335 | 337 | 0.58 | 0.63 |

*Time of development

Table IV indicates that Films A and B have gammas within 10% of each other, but Film B shows a significant increase in red speed (+0.12 log E) over Film A. This red speed increase in the expected result of the switch from a CNF-II to a CNF-IV layer arrangement as presented in Eeles and O'Neill U.S. Pat. No. 4,184,876. The step tablet exposures for the two films were also measured for granularity using a densitometer with a 48 μm aperture. The raw granularity values (Sd×1000) for each film for red and green at several log exposure steps which encompass the normal exposure range for these films are recorded and compared in Table V below. Assuming that a 5% difference in Sd=1 grain unit, grain unit differences for the red and green color records for the two films were calculated and listed in Table V.

TABLE V

Granularity Comparison for Films A & B in Normal C-41 Process

| Film | TOD | Color | Sd × 1000 at Exposure Step 15 | 13 | 11 | 9 | 7 |
|---|---|---|---|---|---|---|---|
| A | 3'15" | Red | 12.17 | 13.23 | 13.02 | 11.58 | 10.45 |
| B | 3'15" | Red | 10.52 | 11.58 | 11.97 | 12.38 | 12.08 |
| Diff. in Grain Units = | | | −3.0 | −2.7 | −1.7 | +1.4 | +3.0 |
| A | 3'15" | Green | 16.66 | 14.36 | 12.10 | 10.80 | 9.23 |
| B | 3'15" | Green | 12.73 | 12.46 | 12.85 | 11.07 | 10.72 |
| Diff. in Grain Units = | | | −5.5 | −2.9 | +1.2 | +0.5 | +3.1 |

Both the red and green granularities show a benefit for Film B in the lower scale and for Film A in the upper scale. Thus the granularity position of these two films about a nonnal exposure is judged to be equivalent.

The procedure for obtaining Photographic Modulation Transfer Functions is described in the *Journal Of Applied Photographic Engineering* 6(1):1–8, 1980. Modulation Transfer Functions were obtained for films A and B by exposing them for ¼ second at 60 percent modulation using 60 blue+20 cyan color correction filters. The films were processed in the normal C-41 process outlined in Table III. Cascaded Modulation Transfer (CMT) Acutance ratings at Disc film magnification (11.6×) were determined from the MTF curves and are compared in Table VI below:

TABLE VI

Acutance Comparison for Films A & B in Normal C-41 Process

| Film | TOD | Disc CMT Red | Green |
|---|---|---|---|
| A | 3'15" | 87.9 | 91.3 |
| B | 3'15" | 87.1 | 88.1 |
| CMT Difference = | | −0.8 | −3.2 |

The acutance results show a small loss in red acutance, but a significant loss in green acutance for Film B. This result in green acutance is expected as the switch from the CNF-II to the CNF-IV type layer arrangement trades green acutance for red speed. Finally the color separation gammas for Films A and B were measured and found to be within 10% of each other. Thus the color saturation of Films A and B are judged to be equivalent.

Example 2

Comparison of CNF-II, CNF-IV and CNF-III Multilayer Films at Rapid Processing Conditions The multilayer film structures utilized for this example are shown schematically for Films C, D, E and F in Tables VII, VIII, IX and X respectively. Gelatin was used as a binder in the various film layers.

TABLE VII

Multilayer Film C Structure

| | |
|---|---|
| Overcoat Layer | Same as Film A |
| Fast Yellow Layer | Y-15 (0.215) & S-2 (0.215)<br>Y-14 (0.183) & S-2 (0.092)<br>D-3 (0.097) & S-2 (0.097)<br>C-22 (0.005) (BARC) & S-3 (0.005)<br>Blue Sensitized Silver Iodobromide Emulsion (0.592 Ag)<br>4.1 mole % Iodide T-Grain ™ (2.6 × 0.134 μm)<br>Gelatin (1.53) |

TABLE VII-continued

Multilayer Film C Structure

| | |
|---|---|
| Slow Yellow Layer | Y-15 (0.323) & S-2 (0.323)<br>Y-14 (0.484) & S-2 (0.242)<br>D-3 (0.086) & S-2 (0.086)<br>C-22 (0.011) (BARC) & S-3 (0.011)<br>Blue Sensitized Silver Iodobromide Emulsion (0.108 Ag)<br>4.1 mole % Iodide T-Grain ™ (1.3 × 0.13 μm)<br>Blue Sensitized Silver Iodobromide Emulsion (0.215 Ag)<br>1.5 mole % Iodide T-Grain ™ (1.0 × 0.13 μm)<br>Blue Sensitized Silver Iodobromide Emulsion (0.161 Ag)<br>1.3 mole % Iodide T-Grain ™ (0.54 × 0.84 μm)<br>Gelatin (1.95) |
| Interlayer | Same as Film A |
| Fast Magenta Layer | M-5 (0.108) Magenta Dye Forming Coupler & S-1 (0.086) & ST-5 (0.022) Addendum<br>MC-2 (0.054) Masking Coupler & S-1 (0.108)<br>D-4 (0.011) & S-2 (0.011)<br>Green Sensitized Silver Iodobromide Emulsion (0.484 Ag)<br>4.1 mole % Iodide T-Grain ™ (1.25 × 12 μm)<br>Gelatin (0.742) |
| Mid Magenta Layer | M-5 (0.538) & S-1 (0.430) & ST-5 Addendum (0.108)<br>MC-2 (0.065) Masking Coupler & S-1 (0.129)<br>D-4 (0.043) & S-1 (0.043)<br>Green Sensitized Silver Iodobromide Emulsion (0.538 Ag)<br>4.1 mole % Iodide T-Grain ™ (1.05 × 0.15 μm)<br>Gelatin (0.850) |
| Slow Magenta Layer | M −5 (0.215) & S-1 (0.172) & ST-5 Addendum (0.043)<br>MC-2 (0.065) Masking Coupler & S-1 (0.129)<br>Green Sensitized Silver Iodobromide Emulsion (0.753 Ag)<br>2.6 mole % Iodide T-Grain ™ (0.75 × 0.115 μm)<br>Green Sensitized Silver Iodobromide Emulsion (0.161 Ag)<br>1.3 mole % Iodide T-Grain ™ (0.54 × 0.084 μm)<br>Gelatin (0.990) |
| Interlayer | Same as Film A |
| Fast Cyan Layer | C-12 (0.086) Cyan Dye-Forming Coupler & S-2 (0.086)<br>C-2 (0.030) & B-1 (0.030) DIAR & S-2 (0.060)<br>C-2 (0.048) & D-5 (0.048) DIR & S-1 (0.097)<br>MC-1 (0.032) Masking Coupler<br>Red Sensitized Silver Iodobromide Emulsion (0.430 Ag)<br>4.1 mole % Iodide T-Grain ™ (1.25 × 0.12 μm)<br>Gelatin (0.807) |
| Mid Cyan Layer | C-2 (0.377) & S-2 (0.377)<br>C-2 (0.019) & B-1 (0.019) & S-2 (0.039)<br>C-22 (0.008) & S-3 (0.008)<br>MC-1 (0.032)<br>Red Sensitized Silver Iodobromide Emulsion (0.872 Ag)<br>4.1 mole % Iodide T-Grain ™ (1.05 × 0.115 μm)<br>Gelatin (1.12) |
| Slow Cyan Layer | C-2 (0.538) & S-2 (0.0538)<br>C-2 (0.008) & B-1 (0.008) & S-2 (0.016)<br>C-22 (0.056) & S-3 (0.056)<br>Y-15 (0.065) & S-2 (0.065)<br>Red Sensitized Silver Iodobromide Emulsion (0.517 Ag)<br>4.1 mole % Iodide T-Grain ™ (0.73 × 0.12 μm)<br>Red Sensitized Silver Iodobromide Emulsion (0.828 Ag)<br>1.3 mole % Iodide T-Grain ™ (0.54 × 0.084 μm)<br>Gelatin (1.36) |
| Antihalation Layer | Same as Film A |
| | Cellulose Triacetate Support |

TABLE VIII

Multilayer Film D Structure

| | |
|---|---|
| Overcoat Layer | Same as Film B |
| Fast Yellow Layer | Y-15 (0.215) & S-2 (0.215)<br>D-3 (0.097) & S-2 (0.097)<br>C-22 (0.005) (BARC) & S-3 (0.005) |

TABLE VIII-continued

| Multilayer Film D Structure | |
|---|---|
| | Blue Sensitized Silver Iodobromide Emulsion (0.592 Ag)<br>4.1 mole % Iodide T-Grain ™ (2.6 × .134 μm)<br>Gelatin (10.36) |
| Slow Yellow Layer | Y-15 (0.538) & S-2 (0.538)<br>D-3 (0.086) & S-2 (0.086)<br>C-22 (0.011) (BARC) & S-3 (0.011)<br>Blue Sensitized Silver Iodobromide Emulsion (0.161 Ag)<br>4.1 mole % Iodide T-Grain ™ (1.3 × 0.13 μm)<br>Blue Sensitized Silver Iodobromide Emulsion (0.290 Ag)<br>1.5 mole % Iodide T-Grain ™ (1.0 × 0.13 μm)<br>Blue Sensitized Silver Iodobromide Emulsion (0.1721 Ag)<br>1.3 mole % Iodide T-Grain ™ (0.54 × 0.84 μm)<br>Gelatin (1.95) |
| Interlayer | Same as Film B |
| Fast Magenta Layer | M-5 (0.054) Magenta Dye Forming Coupler & S-1 (0.043) & ST-5 (0.011) Addendum<br>MC-2 (0.086) Masking Coupler & S-1 (0.172)<br>D-4 (0.022) & S-2 (0.022)<br>Green Sensitized Silver Iodobromide Emulsion (0.484 Ag)<br>4.1 mole % Iodide T-Grain ™ (1.25 × 0.12 μm)<br>Gelatin (0.742) |
| Interlayer | Same as Film B |
| Fast Cyan Layer | C-12 (0.054) Cyan Dye Forming Coupler & S-2 (0.054)<br>C-2 (0.030) & B-1 (0.030) DIAR & S-2 (0.060)<br>C-2 (0.048) & D-5 (0.048) DIR & S-1 (0.097)<br>Red Sensitized Silver Iodobromide Emulsion (0.430 Ag)<br>4.1 mole % Iodide T-Grain ™ (1.25 × 0.12 μm)<br>Gelatin (0.807) |
| Interlayer | Same as Film B |
| Slow Magenta Layer | M-5 (0.430) & S-1 (0.344) & ST-5 Addendum (0.086)<br>MC-2 (0.129) Masking Coupler & S-1 (0.258)<br>D-4 (0.032) & S-2 (0.032)<br>Green Sensitized Silver Iodobromide Emulsion (0.430 Ag)<br>4.1 mole % Iodide T-Grain ™ (1.16 × 0.114 μm)<br>Green Sensitized Silver Iodobromide Emulsion (0.592 Ag)<br>1.5 mole % Iodide T-Grain ™ (0.69 × 0.117 μm)<br>Gelatin (0.850) |
| Interlayer | Same as Film B |
| Slow Cyan Layer | C-2 (0.753) & S-2 (0.753)<br>C-22 (0.008) & S-3 (0.008)<br>Red Sensitized Silver Iodobromide Emulsion (1.076 Ag)<br>4.1 mole % Iodide T-Grain ™ (1.19 × 0.114 μm)<br>Red Sensitized Silver Iodobromide Emulsion (0.646 Ag)<br>1.3 mole % Iodide T-Grain ™ (0.54 × 0.084 μm)<br>Gelatin (1.12) |
| Antihalation Layer | Same as Film B |
| | Cellulose Triacetate Support |

TABLE IX

| Multilayer Film E Structure | |
|---|---|
| Overcoat Layer | Same as Film B |
| Fast Yellow Layer | Y-15 (0.183) & S-2 (0.183)<br>D-3 (0.097) & S-2 (0.097)<br>C-22 (0.005) (BARC) & S-3 (0.005)<br>Blue Sensitized Silver Iodobromide Emulsion (0.592 Ag)<br>4.1 mole % Iodide T-Grain ™ (2.6 × 0.134 μm)<br>Gelatin (1.36) |
| Slow Yellow Layer | Y-15 (0.473) & S-2 (0.473)<br>D-3 (0.086) & S-2 (0.086)<br>C-22 (0.011) (BARC) & S-3 (0.011)<br>Blue Sensitized Silver Iodobromide Emulsion (0.161 Ag)<br>4.1 mole % Iodide T-Grain ™ (1.3 × 0.13 μm)<br>Blue Sensitized Silver Iodobromide Emulsion (0.248 Ag)<br>1.5 mole % Iodide T-Grain ™ (1.0 × 0.13 μm) |

TABLE IX-continued

| Multilayer Film E Structure | |
|---|---|
| | Blue Sensitized Silver Iodobromide Emulsion (0.1721 Ag)<br>1.3 mole % Iodide T-Grain ™ (0.54 × 0.84 μm)<br>Gelatin (1.95) |
| Interlayer | Same as Film B |
| Fast Magenta Layer | M-5 (0.065) Magenta Dye Forming Coupler & S-1 (0.052) & ST-5 (0.013) Addendum<br>MC-2 (0.086) Masking Coupler & S-1 (0.172)<br>D-4 (0.022) & S-2 (0.022)<br>Green Sensitized Silver Iodobromide Emulsion (0.484 Ag)<br>4.1 mole % Iodide T-Grain ™ (1.25 × 0.12 μm)<br>Gelatin (0.742) |
| Interlayer | Same as Film B |
| Fast Cyan Layer | C-12 (0.054) Cyan Dye Forming Coupler & S-2 (0.054)<br>C-2 (0.030) & B-1 (0.030) DIAR & S-2 (0.060)<br>C-2 (0.048) & D-5 (0.048) DIR & S-1 (0.097)<br>Red Sensitized Silver Iodobromide Emulsion (0.430 Ag)<br>4.1 mole % Iodide T-Grain ™ (1.25 × 0.12 μm)<br>Gelatin (0.807) |
| Interlayer | Same as Film B |
| Slow Magenta Layer | M-5 (0.323) & S-1 (0.258) & ST-5 Addendum (0.065)<br>MC-2 (0.129) Masking Coupler & S-1 (0.258)<br>D-4 (0.032) & S-2 (0.032)<br>Green Sensitized Silver Iodobromide Emulsion (0.323 Ag)<br>4.1 mole % Iodide T-Grain ™ (1.16 × 0.114 μm)<br>Green Sensitized Silver Iodobromide Emulsion (0.484 Ag)<br>1.5 mole % Iodide T-Grain ™ (0.69 × 0.117 μm)<br>Gelatin (0.850) |
| Interlayer | Same as Film B |
| Slow Cyan Layer | C-2 (0.753) & S-2 (0.753)<br>C-22 (0.008) & S-3 (0.008)<br>Red Sensitized Silver Iodobromide Emulsion (1.076 Ag)<br>4.1 mole % Iodide T-Grain ™ (1.19 × 0.114 μm)<br>Red Sensitized Silver Iodobromide Emulsion (0.646 Ag)<br>1.3 mole % Iodide T-Grain ™ (0.54 × 0.084 μm)<br>Gelatin (1.12) |
| Antihalation Layer | Same as Film B |
| | Cellulose Triacetate Support |

TABLE X

| Multilayer Film F Structure | |
|---|---|
| Overcoat Layer | Same as Film A |
| Fast Yellow Layer | Y-15 (1.076) & S-2 (1.076)<br>Y-14 (0.183) & S-2 (0.092)<br>D-3 (0.097) & S-2 (0.097)<br>C-22 (0.005) (BARC) & S-3 (0.005)<br>Blue Sensitized Silver Iodobromide Emulsion (0.592 Ag)<br>4.1 mole % Iodide T-Grain ™ (2.6 × 0.134 μm)<br>Gelatin (1.35) |
| Interlayer | ST-4 Oxidized Developer Scavenger (0.075) & S-2 (0.122)<br>Gelatin (0.430) |
| Fast Magenta Layer | M-5 (0.161) Magenta Dye Forming Coupler & S-1 (0.129) & ST-5 (0.032) Addendum<br>MC-2 (0.054) Masking Coupler & S-1 (0.108)<br>D-4 (0.011) & S-2 (0.011)<br>Green Sensitized Silver Iodobromide Emulsion (0.484 Ag)<br>4.1 mole % Iodide T-Grain ™ (1.25 × 12 μm)<br>Gelatin (0.742) |
| Interlayer | ST-4 (0.075) & S-2 (0.122)<br>Gelatin (0.430) |
| Fast Cyan Layer | C-12 (0.054) Cyan Dye-Forming Coupler & S-2 (0.054)<br>C-2 (0.030) & B-1 (0.030) DIAR & S-2 (0.060)<br>C-2 (0.048) & D-5 (0.048) DIR & S-1 (0.097)<br>MC-1 (0.032) Masking Coupler |

TABLE X-continued

| Multilayer Film F Structure | |
|---|---|
| | Red Sensitized Silver Iodobromide Emulsion (0.430 Ag) |
| | 4.1 mole % Iodide T-Grain ™ (1.25 × 0.12 μm) |
| | Gelatin (0.807) |
| Interlayer | ST-4 (0.075) & S-2 (0.122) |
| | Gelatin (0.430) |
| Slow Yellow Layer | Y-15 (0.646) & S-2 (0.646) |
| | Y-14 (0.484) & S-2 (0.242) |
| | D-3 (0.086) & S-2 (0.086) |
| | C-22 (0.011) (BARC) & S-3 (0.011) |
| | Blue Sensitized Silver Iodobromide Emulsion (0.861 Ag) |
| | 4.1 mole % Iodide T-Grain ™ (1.3 × 0.13 μm) |
| | Blue Sensitized Silver Iodobromide Emulsion (0.538 Ag) |
| | 1.5 mole % Iodide T-Grain ™ (1.0 × 0.13 μm) |
| | Blue Sensitized Silver Iodobromide Emulsion (0.215 Ag) |
| | 1.3 mole % Iodide T-Grain ™ (0.54 × 0.84 μm) |
| | Gelatin (1.95) |
| Interlayer | Dye-4 Filter Dye (0.108) |
| | ST-4 (0.086) & S-2 (0.139) |
| | Gelatin (0.430) |
| Slow Magenta Layer | M-5 (0.753) & S-1 (0.603) & ST-5 Addendum (0.151) |
| | MC-2 (0.065) Masking Coupler & S-1 (0.129) |
| | D-4 (0.043) & S-1 (0.043) |
| | Green Sensitized Silver Iodobromide Emulsion (0.215 Ag) |
| | 4.1 mole % Iodide T-Grain ™ 1.16 × 0.114 μm) |
| | Green Sensitized Silver Iodobromide Emulsion (0.430 Ag) |
| | 1.5 mole % Iodide T-Grain ™ (0.69 × 0.117 μm) |
| | Gelatin (0.850) |
| Interlayer | ST-4 (0.075) & S-2 (0.122) |
| | Gelatin (0.430) |
| Slow Cyan Layer | C-2 (0.753) & S-2 (0.753) |
| | C-22 (0.008) & S-3 (0.008) |
| | Red Sensitized Silver Iodobromide Emulsion (1.076 Ag) |
| | 4.1 mole % Iodide T-Grain ™ (1.19 × 0.115 μm) |
| | Red Sensitized Silver Iodobromide Emulsion (0.646 Ag) |
| | 4.1 mole % Iodide T-Grain ™ (0.54 × 0.084 μm) |
| | Gelatin (1.12) |
| Antihalation Layer | Same as Film A |
| | Cellulose Triacetate Support |

All three films C, D, E and F were exposed through a step tablet on a 1B sensitometer and processed through the KODAK FLEXICOLOR™ C-41 process described in Table III above. The Status M densities of the processed films were then measured via a densitometer and density vs log exposure curves were plotted and measured. The red and green inertial speeds were measured at densities=Dmin+0.15 and the red and green gammas were measured via a least squares fit to the sensitometric curves. The speeds and gammas for Films C, D, E and F in their respective processes are compared in Table XI below:

TABLE XI

Sensitometric Comparison of Films C, D, E and F in Rapid C-41 Processes

| | Development | | Relative Speed | | Gammas | |
|---|---|---|---|---|---|---|
| Film | Time | Temp. | Red | Green | Red | Green |
| C | 2' | 37.8 C. | 307 | 320 | 0.64 | 0.73 |
| D | 2' | 37.8 C. | 326 | 320 | 0.58 | 0.64 |
| E | 1' | 48.9 C. | 334 | 329 | 0.58 | 0.62 |
| F | 2' | 37.8 C. | 326 | 338 | 0.51 | 0.58 |

Table XI indicates that Films C, D, and E have gammas that are within 10% of each other, however Films D and E show substantial increases in red speed as compared to Film C. This red speed increase is the expected result of the switch from CNF-II to CNF-IV type layer arrangement as presented in Eeles and O'Neill U.S. Pat. No. 4,184,876, however, the magnitude of the red speed is significantly greater than that shown for normal processing conditions (See Table IV.). Although Film F shows gammas that are about 20% lower than Film C, it shows a substantial increase in red speed. Since the fast cyan is moved closer to the top of the film in CNF-III similarly to CNF-IV type layer arrangement, a red speed increase is expected. The step tablet exposures for the four films were also measured for granularity using a densitometer with a 48 μm aperture. The raw granularity values (Sd×1000) for each film for each color at several log exposure steps which encompass the normal exposure range for these films are recorded and compared in Table XII below. Assuming that a 5% difference in Sd=1 grain unit, grain unit differences for the red and green records for Film D versus Film C, Film E versus Film C and Film F versus Film C are listed in Table XII.

TABLE XII

Granularity Comparison for Films C, D, E & F in Rapid C-41 Process

| | Process | | | Sd × 1000 at Exposure Step | | | | |
|---|---|---|---|---|---|---|---|---|
| Film | Time | Temp. | Color | 15 | 13 | 11 | 9 | 7 |
| C | 2' | 37.8 C. | Red | 7.11 | 8.99 | 8.51 | 8.25 | 7.11 |
| D | 2' | 37.8 C. | Red | 8.57 | 9.10 | 9.38 | 10.06 | 10.17 |
| Diff. in Grain Units = | | | | +3.8 | +0.2 | +2.0 | +4.1 | +7.3 |
| C | 2' | 37.8 C. | Green | 12.21 | 12.05 | 11.62 | 10.65 | 10.64 |
| D | 2' | 37.8 C. | Green | 9.76 | 10.64 | 10.17 | 10.08 | 9.49 |
| Diff. in Grain Units = | | | | −4.6 | −2.5 | −2.7 | −0.9 | −2.3 |
| C | 2' | 37.8 C. | Red | 7.11 | 8.99 | 8.51 | 8.25 | 7.11 |
| E | 1' | 48.9 C. | Red | 9.75 | 9.21 | 9.25 | 9.54 | 9.99 |
| Diff. in Grain Units = | | | | +6.5 | +0.5 | +1.7 | +3.0 | +7.0 |
| C | 2' | 37.8 C. | Green | 12.21 | 12.05 | 11.62 | 10.65 | 10.64 |
| E | 1' | 48.9 C. | Green | 11.10 | 11.40 | 11.33 | 10.60 | 9.72 |
| Diff. in Grain Units = | | | | −1.9 | −1.1 | −0.5 | −0.1 | −1.8 |
| C | 2' | 37.8 C. | Red | 7.11 | 8.99 | 8.51 | 8.25 | 7.11 |
| F | 2' | 37.8 C. | Red | 7.57 | 8.18 | 8.79 | 8.99 | 8.42 |
| Diff. in Grain Units = | | | | +1.3 | −1.9 | +0.6 | +1.7 | +3.5 |
| C | 2' | 37.8 C. | Green | 12.21 | 12.05 | 11.62 | 10.65 | 10.64 |
| F | 2' | 37.8 C. | Green | 12.77 | 12.32 | 12.50 | 11.90 | 10.67 |
| Diff. in Grain Units = | | | | +0.9 | +0.4 | +1.5 | +2.3 | +.06 |

The granularity data show a red granularity penalty for the CNF-IV films (D & E) which is roughly commensurate with their red speed increases. The same conclusion can be drawn for the red granularity of the CNF-III film (F) when its lower gamma is accounted for. The green granularity data shows an unexpected green granularity benefit from the CNF-IV films (D & E) as compared to the CNF-II film which was not seen for the normally processed films in Table V. The green granularity benefit for Film E is slightly less than for Film D due to the higher green speed position of Film E (See Table XI.). Despite its lower gamma, the CNF-III film (F) shows no benefit in green granularity compared to the CNF-II film.

Using the procedure described in Example 2, Modulation Transfer Functions were obtained for Films C, D, E, and F by exposing them for ¼ second at 60 percent modulation using 60 blue+20 cyan cc filters. The films were processed in the same manner as the sensitometry. Following processing, Cascaded Modulation Transfer (CMT) acutance ratings at Disc film magnification (11.6×) were determined from the MTF curves and are compared in Table XIII below:

TABLE XIII

Acutance Comparison for Films C, D, E & F in Rapid C-41 Process

| | Development | | Disc CMT | |
|---|---|---|---|---|
| Film | Time | Temperature | Red | Green |
| C | 2' | 37.8 C. | 79.9 | 87.1 |
| D | 2' | 37.8 C. | 84.9 | 87.9 |
| E | 1' | 48.9 C. | 86.8 | 88.0 |
| F | 2' | 37.8 C. | 82.7 | 85.8 |

The acutance results show significant increases in red acutance for the CNF-IV films (D & E) rather than the small loss in red acutance shown in Table VI for the normally processed films. These increases in red acutance are far greater than any expected. The CNF-III film F also shows an increase in red acutance but one that is significantly less than that shown for the CNF-IV films (D & E). In addition these results show a small green acutance gain for the CNF-IV films (D & E) rather than the expected loss seen for the normally processed films (See Table VI.) and for the CNF-III film F. Finally the color separation gammas for Films C, D, E, and F were measured and found to be within 10% of each other. Thus the color saturations of the three films are judged to be equivalent.

Glossary of Acronyms

S-1 = Tritolyl phosphate

S-2 = Dibutyl phthalate

S-3 = *N*, *N*-Diethyldodecanamide

S-9 = 1,4-Cyclohexyldimethylene bis(2-ethylhexanoate)

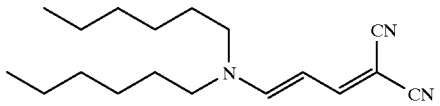

UV-7

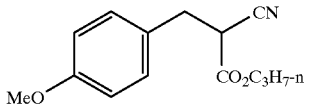

UV-8

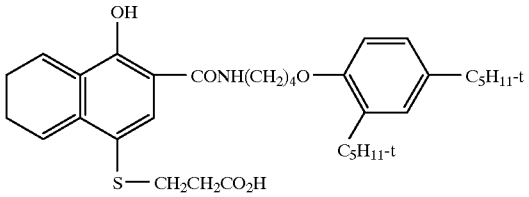

B-1

-continued
Y-14
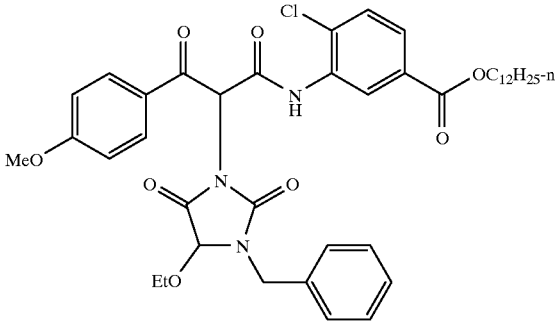
Y-15
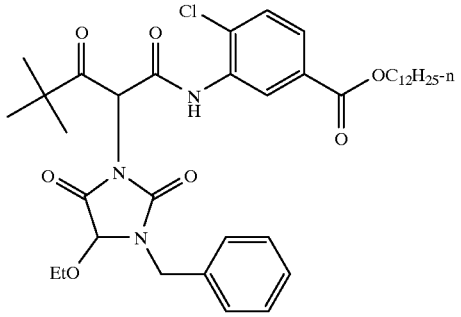
DYE 4
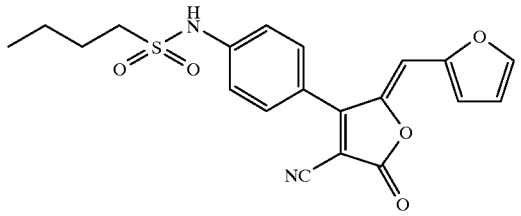
DYE 5
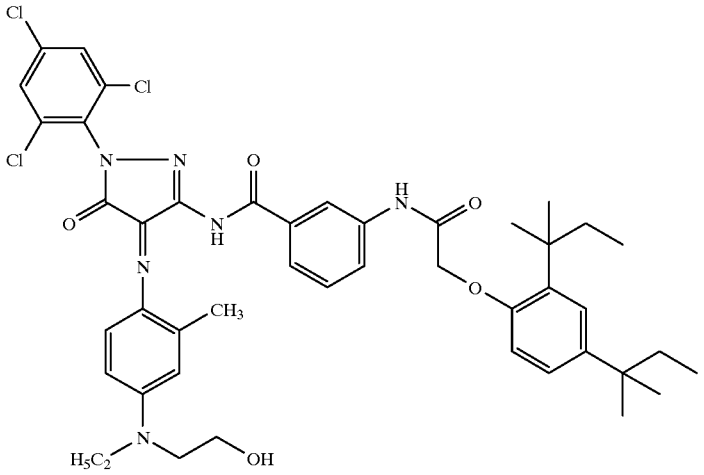

-continued
DYE 6
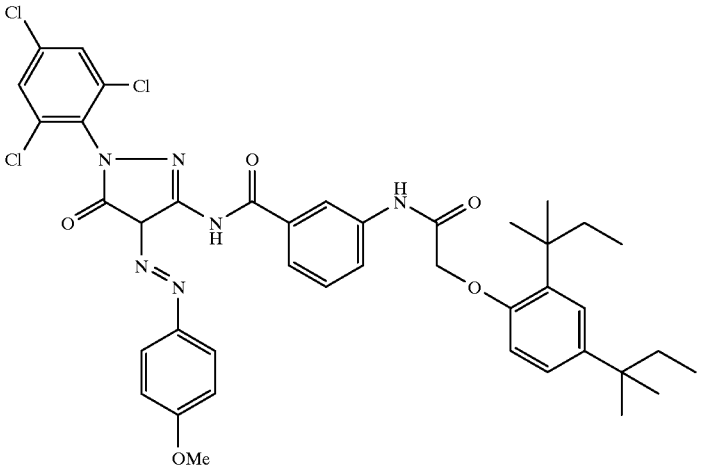
DYE 7
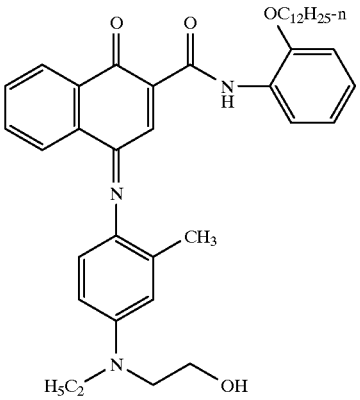
C-2
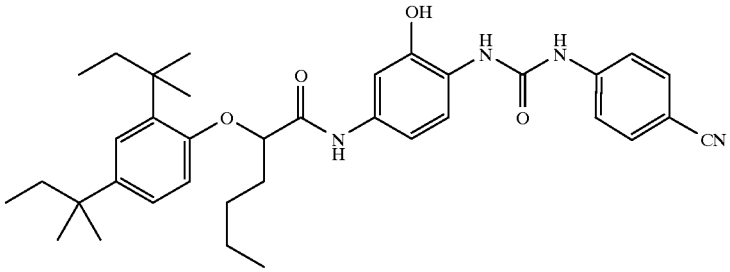
C-12
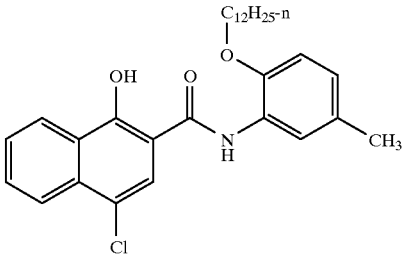

-continued
C-22
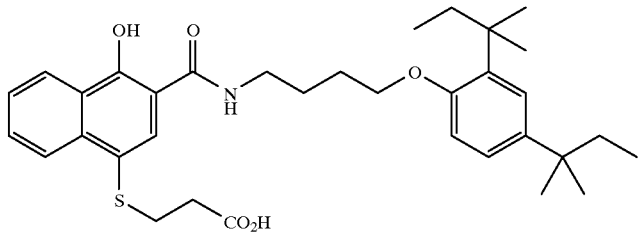
D-3
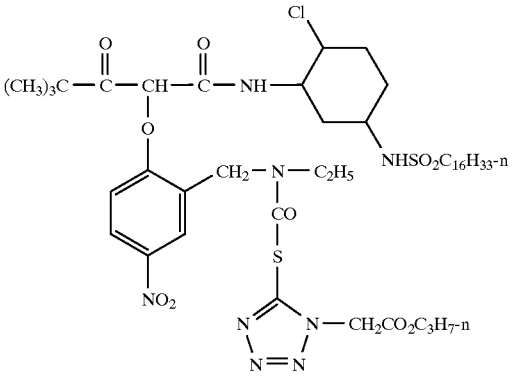
D-4
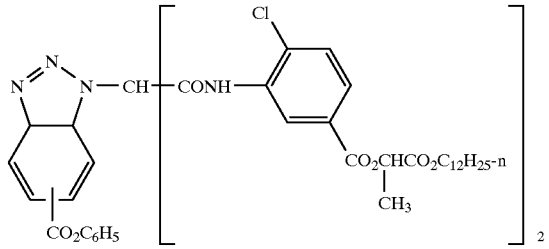
D-5
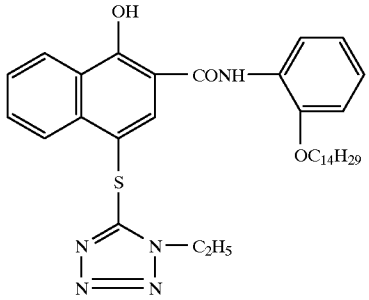
ST-4
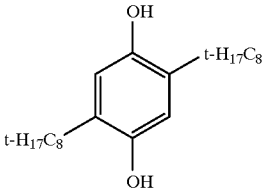

-continued
ST-5
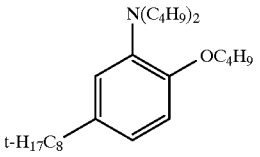
M-5
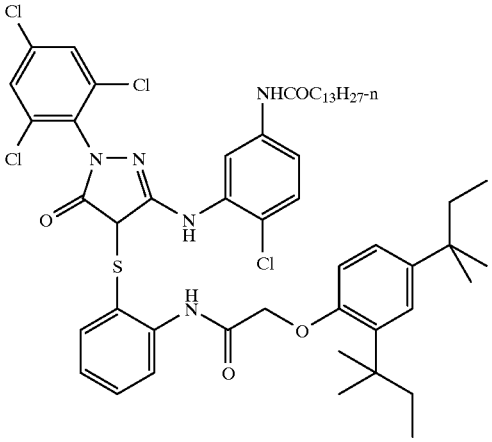
MC-1
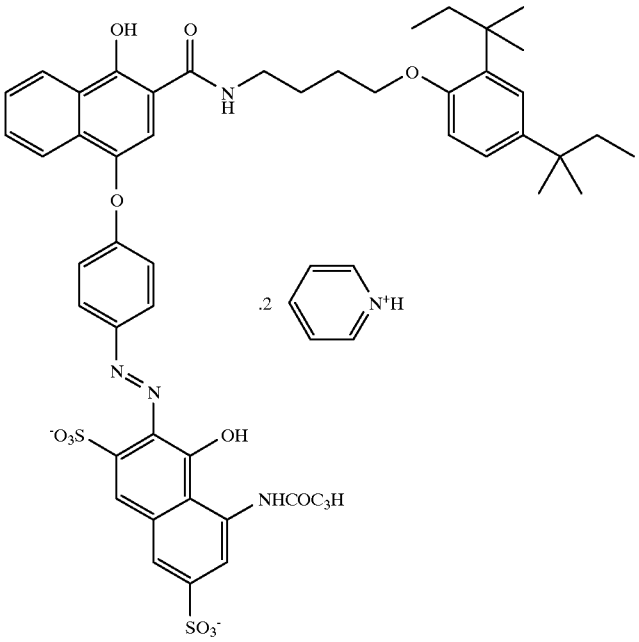

-continued

MC-2

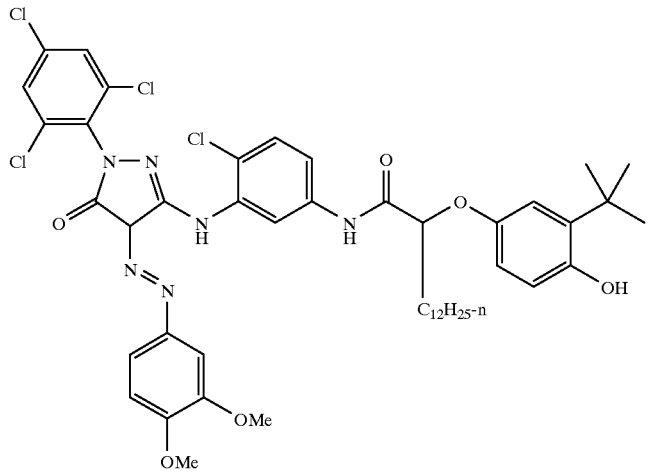

The invention has been described in detail with particular reference to preferred embodiments thereof, but it will be understood that variations and modifications can be effected within the spirit and scope of the invention.

What is claimed is:

1. A photographic element capable of producing a color negative image comprised of a transparent film support and, coated on the support, a blue recording layer unit, containing blue sensitive silver iodobromide grains and yellow dye-forming coupler, located to receive exposing radiation prior to all other recording layer units, a yellow filter layer located to receive exposing radiation from the blue recording layer unit, a pair of recording layer units located to receive exposing radiation from the yellow filter layer consisting of a fast green recording layer unit and a fast red recording layer unit, and at one least one pair of slow green and slow red recording layers units located to receive exposing radiation from the fast green and fast red recording layer units, each green recording layer unit containing green sensitized silver iodobromide grains and magenta dye-forming coupler, each red recording layer unit containing red sensitized silver iodobromide grains and cyan dye-forming coupler, and in each recording layer unit pair the green recording layer unit being positioned to receive exposing radiation prior to the red recording layer unit,

WHEREIN, the green recording layer units together contain at least 1.0 g/m$^2$ of silver with at least 60 percent of the silver in the green recording layer units being in a location other than the fast green recording layer unit, and the red recording layer units together contain at least 1.8 g/m$^2$ of silver with at least 70 percent of the silver in the red recording layer units being in a location other than the fast red recording layer unit.

2. A photographic element according to claim 1 wherein the fast green recording layer unit contains at least 20 percent of the total silver in the green recording layer units.

3. A photographic element according to claim 1 wherein the fast green recording layer unit contains at least 30 percent of the total silver in the green recording layer units.

4. A photographic element according to claim 1 wherein the green recording layer units together contain from 1.0 to 2.8 g/m$^2$ silver.

5. A photographic element according to claim 1 wherein the red recording layer units other than the fast red recording layer unit contain at least 75 percent of the total silver in the red recording layer units.

6. A photographic element according to claim 1 wherein the fast red recording layer unit contains at least 10percent of total silver in the red recording layer units.

7. A photographic element according to claim 1 wherein the green recording layer units together contain from 1.8 to 3.6 g/m$^2$ silver.

8. A photographic element capable of producing a color negative image comprised of a transparent film support and, coated on the support, a blue recording layer unit, containing blue sensitive silver iodobromide grains and yellow dye-forming coupler, located to receive exposing radiation prior to all other recording layer units, a yellow filter layer located to receive exposing radiation from the blue recording layer unit, a pair of recording layer units located to receive exposing radiation from the yellow filter layer consisting of a fast green recording layer unit and a fast red recording layer unit, and at one least one pair of slow green and slow red recording layers units located to receive exposing radiation from the fast green and fast red recording layer units, each green recording layer unit containing green sensitized silver iodobromide grains and magenta dye-forming coupler, each red recording layer unit containing red sensitized silver iodobromide grains and cyan dye-forming coupler, and in each recording layer unit pair the green recording layer unit being positioned to receive exposing radiation prior to the red recording layer unit,

WHEREIN, the green recording layer units together contain from 1.0 to 2.8 g/m$^2$ of silver with from 60 to 80 percent of the silver in the green recording layer units being in a location other than the fast green recording layer unit, and the red recording layer units together contain from 1.8 to 3.6 g/m$^2$ of silver with from 75 to 90 percent of the silver in the red recording layer units being in a location other than the fast red recording layer unit.

9. A process of producing a color negative image comprised of developing an imagewise exposed photographic element according to claim 1 in 2 minutes or less to create a silver image and yellow, magenta and cyan dye images, bleaching the silver image, and fixing to remove silver halide.

10. A process of producing a color negative image comprised of developing an imagewise exposed photographic element according to claim 8 in from 30 seconds to 2 minutes to create a silver image and yellow, magenta and cyan dye images, bleaching the silver image, and fixing to remove silver halide.

* * * * *